US008038274B2

(12) United States Patent
Ujita et al.

(10) Patent No.: US 8,038,274 B2
(45) Date of Patent: Oct. 18, 2011

(54) INK TANK FOR INK JET RECORDING DEVICE

(75) Inventors: Toshihiko Ujita, Yokohama (JP); Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1021 days.

(21) Appl. No.: 11/797,926

(22) Filed: May 9, 2007

(65) Prior Publication Data

US 2007/0273735 A1 Nov. 29, 2007

(30) Foreign Application Priority Data

May 24, 2006 (JP) ..... 2006-144164

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 4,415,886 | A * | 11/1983 | Kyogoku et al. | 340/618 |
| 5,971,533 | A * | 10/1999 | Kinoshita et al. | 347/86 |
| 6,270,206 | B1 | 8/2001 | Shimizu et al. | 347/86 |
| 6,365,701 | B1 * | 4/2002 | Hayashi et al. | 528/75 |
| 6,382,783 | B1 | 5/2002 | Hayashi et al. | 347/85 |
| 6,450,631 | B1 | 9/2002 | Hayashi et al. | 347/86 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,719,415 | B1 | 4/2004 | Hattori et al. | 347/86 |
| 6,805,434 | B2 | 10/2004 | Hayashi et al. | 347/85 |
| 7,014,306 | B2 | 3/2006 | Netsu et al. | 347/86 |
| 7,185,975 | B2 * | 3/2007 | Morita | 347/86 |
| 2004/0105941 | A1 * | 6/2004 | Terada et al. | 428/34.2 |
| 2007/0103493 | A1 * | 5/2007 | Tsukada et al. | 347/7 |

FOREIGN PATENT DOCUMENTS

| | | |
|---|---|---|
| JP | 05-162334 A | 6/1993 |
| JP | 6-135000 | 5/1994 |
| JP | 07-132612 A | 5/1995 |
| JP | 7-323570 | 12/1995 |

* cited by examiner

*Primary Examiner* — Anh T. N. Vo

(74) *Attorney, Agent, or Firm* — Fitzpatrick, Cella, Harper & Scinto

(57) ABSTRACT

There is disclosed an ink tank capable of inhibiting penetration of a gas even in an ink storage section made of a resin, having such a flexibility as to easily apply a negative pressure to ink, having an excellent resource protective property and applicable even to a small and inexpensive ink jet recording device having a large degree of freedom in design. In the ink tank for the ink jet recording device having the ink storage section made of a plastic, the ink storage section has a coating layer including a liquid retaining member capable of retaining ink on an inner surface or an outer surface thereof. The liquid retaining member can include a foam material, a fiber material or a gel-like substance. In the ink storage section, the liquid retaining member included in the coating layer including the liquid retaining member capable of retaining the ink on the outer surface thereof includes a moisture adsorbent which adsorbs a moisture.

5 Claims, 7 Drawing Sheets

INK TANK FOR INK JET RECORDING DEVICE

BACKGROUND OF THE INVENTION

1. Field of the Invention

The present invention relates to an ink tank for an ink jet recording device, which inhibits penetration of a gas and which is suitable for a small-sized flexible ink jet recording device having a high use efficiency of ink.

2. Description of the Related Art

An ink jet recording device includes an ink jet recording head which flies ink as liquid droplets in response to an applied electric signal, and the ink is supplied to the head from an ink reservoir referred to as an ink tank or an ink cartridge through an ink channel. During the supply of the ink, it is demanded that an appropriate negative pressure be maintained with respect to the recording head, evaporation of the ink be prevented to inhibit a change of a physical property and generation and mixture of bubbles in the ink be inhibited to smoothly distribute the ink.

The inhibition of the evaporation of the ink is noted in a supply system of the ink. For example, when several percentages of a volatile component of the ink evaporate, a substantially usable amount of the ink decreases. In addition, viscosity increases, and the ink is not smoothly discharged from the ink jet recording head. When a component that easily volatilizes preferentially evaporates and a ratio between a polar solvent and a non-polar solvent fluctuates, the ink is sometimes separated. When an image is output with the ink having its properties changed in this manner, a long time is required for drying the ink attached to paper, and the ink migrates. As a result, problems such as color mixture and deterioration of a resolution of the image occur in some case.

In general, a plastic is used as a material of an ink storage section of the ink tank (Japanese Patent Application Laid-Open No. H07-323570). Since an olefin-based resin such as polypropylene is chemically stable, inexpensive and easily moldable by injection molding, the resin is frequently used. High-impact polystyrene, noryl resin and polysulfone have a gas penetration ratio higher than that of the olefin-based resin, and have a slightly deteriorated resistance to evaporation, but are used in a case where a mechanical strength higher than that of the olefin-based resin is required. Furthermore, even when a bag made of such a plastic is used in the storage section of the ink and the stored ink of a pigment sedimentation system needs to be periodically stirred, an external force can easily be applied to stir the ink.

However, in the ink storage section of the bag made of such a plastic, the gas penetrates the resin. When the ink is volatilized or consumed, outside air invades an inner space of the storage section to cause a problem. As shown in, for example, FIGS. 7A, 7B and 7C, in an ink tank having an outer vessel 701 and an ink storage section 702 made of a plastic and disposed in the vessel, a bubble 704 of a gas volatilized from an ink component is generated in the ink storage section in which ink 703 is stored (FIG. 7A). Outside air 706 invades a portion 705 of the ink storage section which comes into contact with this bubble to enlarge the bubble 704 (FIG. 7B). Furthermore, a volume of the bubble continues to be enlarged to increase an inner pressure (FIG. 7C). In the worst case, the ink storage section 702 cannot bear the inner pressure, and is sometimes damaged.

It is known that a mechanism in which the outside air invades this plastic bag is caused by an osmic pressure generated by a difference between a vapor concentration of the ink component of the bubble 704 in the ink storage section and a vapor concentration of the ink component included in the outside air.

$$\Delta P=(n1-n2)RT:$$

n1: ink vapor mol concentration [mol/l] in the ink storage section;

n2: ink vapor mol concentration [mol/l] in the outside air; and

R: gas constant (0.082 [(atm/K)·mol].

Specifically, ΔP indicates that the outside air penetrates a bag member to invade the ink storage section owing to a function of reducing a vapor pressure difference of the ink component between the inside and the outside of the ink storage section, that is, a function of reducing a molar fraction of the ink component in the section. However, the vapor pressure of the ink component in the ink storage section is sufficiently higher than that of the ink component in the outside air. Therefore, ΔP of the above equation is semi-permanently present, and inflow of the air semi-permanently continues.

To solve such a problem of the invasion of the outside air into the ink storage section of the resin bag, a method is reported in which a vapor density difference between the inside and the outside of the ink storage section is reduced in a stepwise manner by use of a wall having a double structure (Japanese Patent Application Laid-Open No. H06-135000).

Moreover, for the ink storage section of the bag made of the plastic resin, a substance having a small gas penetration ratio is selected. The section is constituted by laminating a film of a metal such as aluminum to reduce the gas penetration ratio. A so-called laminated film is used in the section.

However, to obtain a sufficient effect of preventing the inflow of the outside air, such a laminated film requires a plastic film having a thickness of about 50 μm at minimum and an aluminum foil having a thickness of about 10 μm. The film is formed of a remarkably hard material which is not easily bent. As a result, it is difficult to reduce a capacity of the ink storage section with the consumption of the ink. There is a problem that all the stored ink cannot be used. A so-called use-up property deteriorates.

Furthermore, in the ink tank, the ink bag is expanded using a force of a spring to apply the negative pressure to the ink. Since the ink bag formed of the laminated film has a high mechanical rigidity, it is difficult to adjust the capacity of the ink bag with the consumption of the ink. As a result, the negative pressure applied to the ink tends to be unstable. Furthermore, it is difficult to sort the laminated film during disposal of the film as garbage. Therefore, there is a problem of resource protection.

SUMMARY OF THE INVENTION

An object of the present invention is to provide an ink tank capable of inhibiting penetration of a gas even in an ink storage section made of a resin, having such a flexibility as to stably apply a negative pressure to ink, having an excellent resource protective property and applicable even to a small and inexpensive ink jet recording device having a large degree of freedom in design.

The present inventors have found that an inner surface or an outer surface of an ink storage section made of a plastic can be coated with a coating layer having a liquid retaining member such as a fiber, a foam material or a gel capable of retaining a liquid to inhibit inflow and outflow of a gas between the ink storage section and outside air. Based on such findings, the present invention has been completed.

That is, the present invention is directed to an ink tank for an ink jet recording device having an ink storage section made of a plastic, wherein the ink storage section has a coating layer including a liquid retaining member capable of retaining ink on an inner surface thereof.

Moreover, the present invention is directed to an ink tank for an ink jet recording device having an ink storage section made of a plastic, wherein the ink storage section has a coating layer including a liquid retaining member capable of retaining a liquid on an outer surface thereof.

The ink tank for the ink jet recording device of the present invention is capable of inhibiting penetration of a gas even in the ink storage section made of a resin, has such a flexibility as to stably apply a negative pressure to the ink, has an excellent resource protective property and is applicable even to a small and inexpensive ink jet recording device having a large degree of freedom in design.

Further features of the present invention will become apparent from the following description of exemplary embodiments with reference to the attached drawings.

DESCRIPTION OF THE EMBODIMENTS

Figure 1A:
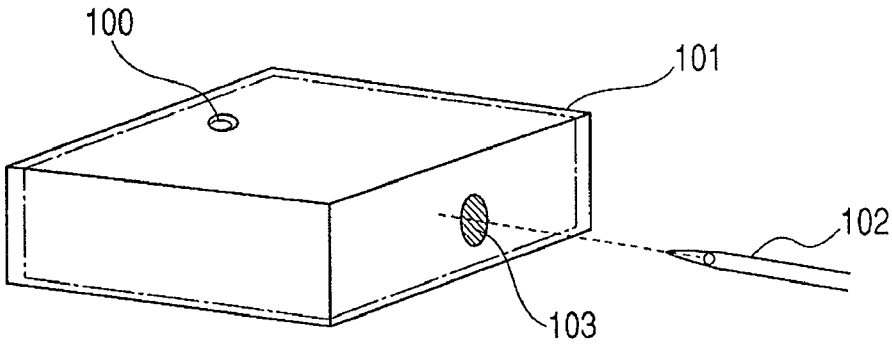
FIGS. 1A and 1B are schematic perspective views illustrating one example of an ink tank for an ink jet recording device according to the present invention.

An ink tank for an ink jet recording device of the present invention is directed to an ink tank for an ink jet recording device having an ink storage section made of a plastic. The ink storage section has a coating layer including a liquid retaining member capable of retaining ink on an inner surface thereof or an impregnated member which can be impregnated with a liquid. Alternatively, the ink storage section has a coating layer including a liquid retaining member capable of retaining the liquid on an outer surface thereof.

There is not any special restriction on the ink tank for the ink jet recording device of the present invention as long as the ink tank includes the ink storage section made of the plastic and having the coating layer including the liquid retaining member capable of retaining the ink on the inner surface thereof or the liquid retaining member capable of retaining the liquid on the outer surface thereof. Examples of a constitution of the ink tank include a constitution having the ink storage section and a guiding section. The guiding section guides the ink stored in this ink storage section to a channel which supplies the ink to an ink jet recording head of the ink jet recording device. When the ink storage section is a bag having flexibility, the ink tank may have an exterior material which supports this bag.

The ink storage section is made of the plastic, and a configuration of the section may be a vessel or a bag, but the section can be the bag having the flexibility because it is easy to apply a negative pressure to the ink. A material of the plastic which forms the ink storage section may be a thermoplastic resin or a thermosetting resin. Specific examples of the material include polypropylene, polyethylene, nylon and ethylene vinyl copolymer.

There is not any restriction on the liquid retaining member or the impregnated member included in the coating layer disposed on the inner surface of the ink storage section, as long as the ink can be retained on the inner surface of the ink storage section. The member has flexibility and chemical stability with respect to the ink. Specific examples of the member include a foam material such as urethane foam, a fabric such as a natural or synthetic fiber, a fiber material such as a non-woven cloth and a gel-like substance such as a protein film. When the liquid retaining member includes the foam material or the fiber material and water included in the ink is volatilized or the ink is consumed, an inner space is formed in the ink storage section. An ink liquid is raised by a capillary function of a liquid retaining member such as the foam material or the fiber material included in a portion of the coating layer which comes into contact with this inner space. The ink liquid forms an ink layer on the inner surface of the ink storage section in an inner space portion. This ink layer can inhibit inflow and outflow of a gas between the inner space of the ink storage section and outside air.

Moreover, even when the liquid retaining member included in the coating layer includes the gel-like substance and the inner space is formed in the ink storage section, the ink retained by the gel-like substance can inhibit the inflow and outflow of the gas between the inner space of the ink storage section and the outside air in the same manner as described above. Examples of the gel-like substance included in the liquid retaining member include a protein, and such a substance may be included in the fiber material or the foam material for use.

In a case where the coating layer is disposed on the outer surface of the ink storage section, examples of the liquid retaining member for use in this layer especially include a moisture adsorbent which adsorbs a moisture from the outside air in addition to the foam material, the fiber material and the gel-like substance described above. When the liquid retaining member included in the coating layer disposed on the outer surface of the ink storage section include the foam material, the fiber material and the gel-like substance, the moisture is supplied to these materials to form a liquid layer on the outer surface of the ink storage section. In consequence, the inflow and outflow of the gas between the inner surface of the ink storage section and the outside air can be inhibited. Examples of the moisture adsorbent for use in the liquid retaining member of the coating layer disposed on the outer surface of the ink storage section include a polymer containing sodium polyacrylate as a main component and calcium chloride. These materials may be attached to the fiber material and the foam material for use. Since these materials efficiently adsorb the moisture from the outside air, a water layer can be formed on the outer surface of the ink storage section without supplying any moisture to the liquid retaining member. In consequence, the inflow and outflow of the gas between the inner surface of the ink storage section and the outside air can be inhibited.

Embodiments

An ink tank for an ink jet recording device of the present invention will hereinafter specifically be described in detail with reference to the drawings, but the technical scope of the present invention is not limited to these embodiments.

Embodiment 1

Figure 1B:
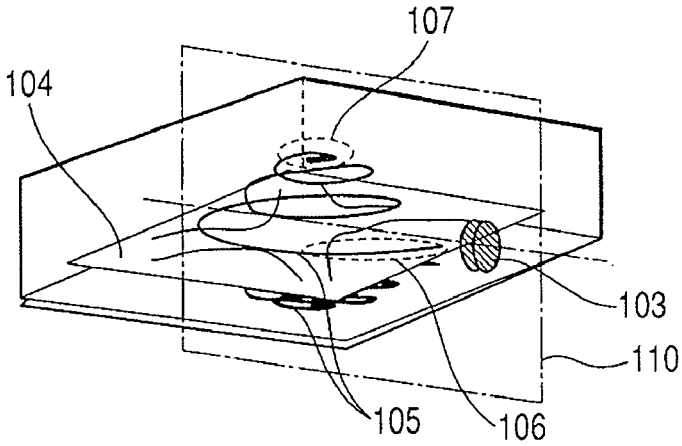
Figure 2:
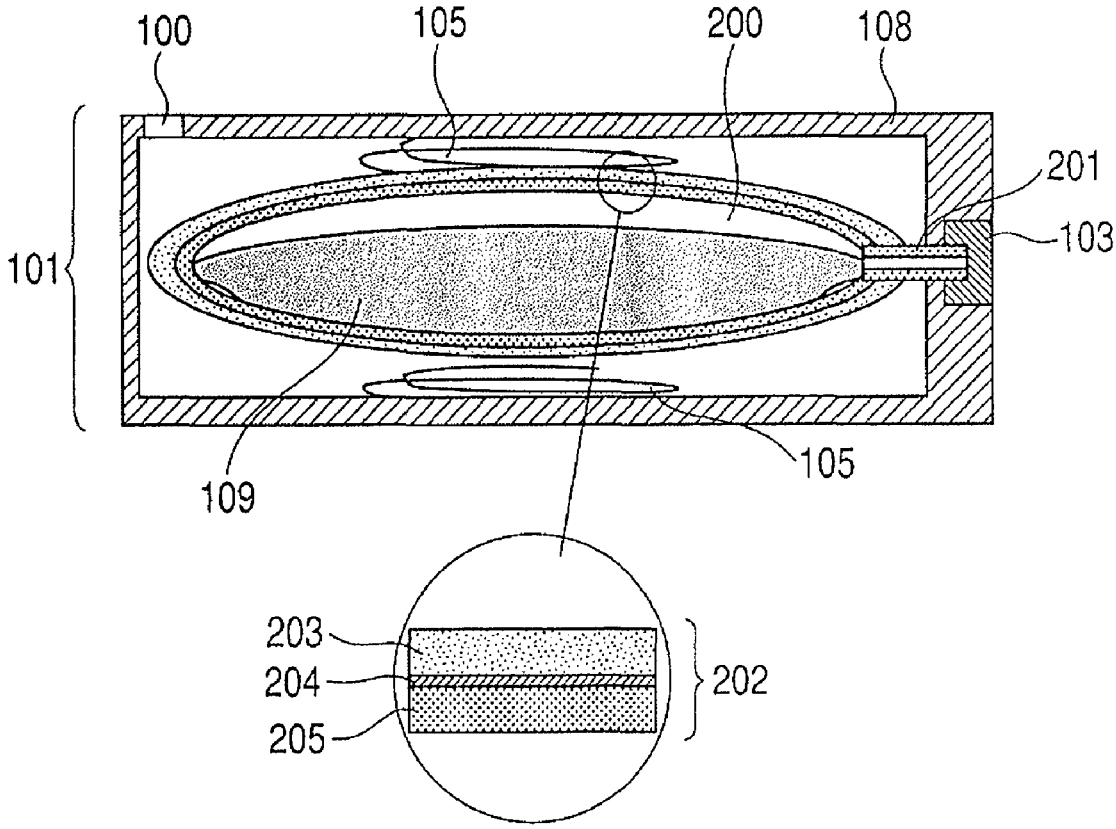
FIG. 2 is a schematic sectional view illustrating the example of the ink tank for the ink jet recording device according to the present invention.

As one example of the ink tank for the ink jet recording device of the present invention, FIGS. 1A, 1B and 2 illustrate a replaceable ink cartridge. FIG. 1A is a schematic perspective view of the ink cartridge, FIG. 1B is a schematic perspective view cut along the broken line of FIG. 1A, and FIG. 2 is a schematic sectional view cut along a broken line 110 of FIG. 1B. The ink cartridge includes an ink bag 104 which is an ink storage section; an exterior material 101 in which the ink bag is stored; a rubber stopper 103 disposed at a side surface of the exterior material; and a guide tube 201 which connects the rubber stopper 103 to the ink bag 104. A hollow needle 102 is inserted into the rubber stopper 103 to form an ink channel between the ink bag and a discharge port of an ink jet recording head. Ink 109 can be derived from the ink bag to the channel, and discharged from the discharge port of the ink jet recording head. In the ink cartridge, as shown in FIG. 1B, coil springs 105 which are a pair of tensile springs are arranged through the ink bag 104. One end portion 106 of the spring is bonded to the ink bag, and the other end portions 107 are bonded to a pair of parallel inner wall surfaces of the exterior material. The coil springs 105 apply, to the ink bag 104, a tensile force toward the inner wall surface of the exterior material, and a negative pressure is applied to the ink 109 of the ink bag 104 with respect to outside air. In consequence, the ink to which an appropriate negative pressure has been applied can be supplied to the head of the ink jet recording device.

The ink bag 104 of such an ink cartridge is formed of a composite material 202 having a coating layer 205 including a liquid retaining member capable of retaining the ink. The coating layer is bonded to an inner side of a plastic film 203 through a bonding layer 204. In this case, the bonding layer can be omitted in a case where the coating layer can be fused to the plastic film 203. Examples of the plastic film 203 include a molded material of polypropylene, polyethylene, nylon or an ethylene vinyl copolymer. A thickness of the plastic film can appropriately be selected in relation to a material of the film and the ink to be stored. Specifically, when priority is given to flexibility, a combination of 15 μm of polyethylene/20 μm of nylon may be used. In consideration of a gas barrier property and tenacity, a combination of 10 μm of polyethylene/10 μm of polyethylene terephthalate may be used. As a combination in which the flexibility and the gas barrier property are well balanced, a combination of 15 μm of polyethylene/10 μm of polypropylene may be used. In addition, various films may be combined and selected according to a size and a shape of the ink bag.

The coating layer 205 includes the liquid retaining member capable of retaining the ink and an impregnated member which can be impregnated with a liquid. Examples of the liquid retaining member and the impregnated member include a fiber material such as a non-woven cloth or fabric made of polyethylene fiber of about 1 to 4 deniers. The coating layer having such a fiber material can retain the ink with a capillary force. In addition, as the liquid retaining member and the impregnated member, a foam material and a gel-like substance may be included as described above.

In such a coating layer, a large amount of the ink 109 is retained by the liquid retaining member. In such a coating layer, when a gas phase 200 is present in the ink bag 104, the ink is supplied to a portion of the coating layer corresponding to a gas phase 200 through the coating layer of a portion present under the surface of the ink with the capillary force. Therefore, the plastic film 203 is separated from the gas phase 200 present in the ink bag through an ink layer between the film and the phase. Since the film does not directly come into contact with the phase, a gas can be inhibited from penetrating the plastic film.

Figure 3A:
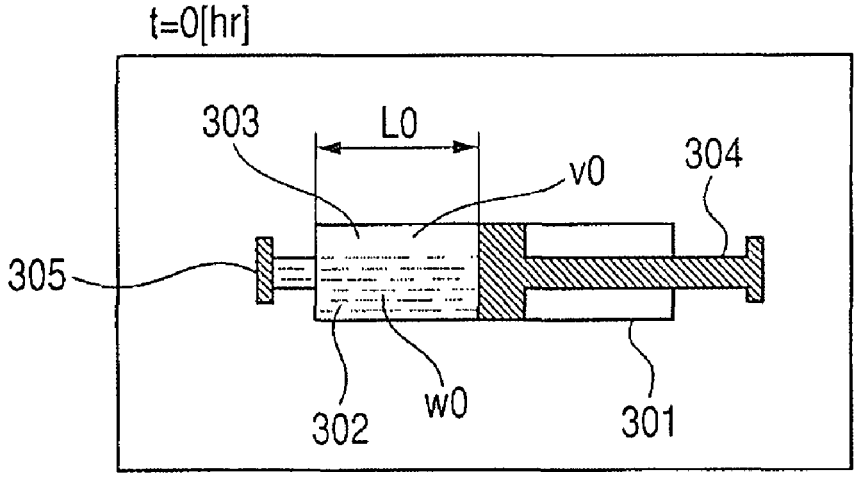
FIGS. 3A and 3B are explanatory views of a function of the ink tank for the ink jet recording device according to the present invention.

A mechanism which inhibits inflow and outflow of the gas between an inner space of the ink bag of the present invention and the outside air will hereinafter be described. As shown in FIG. 3A, an injection syringe 301 made of polypropylene is constituted by storing ink 302 (w0) and air 303 (volume v0) in a syringe having a tip end sealed with a rubber stopper 305 having a low gas penetration property. In the injection syringe, at a time T=0 [hr], a tip end of a piston 304 is present at a position L0. After a period of time, the air 303 is saturated with vapor of the ink.

Figure 3B:
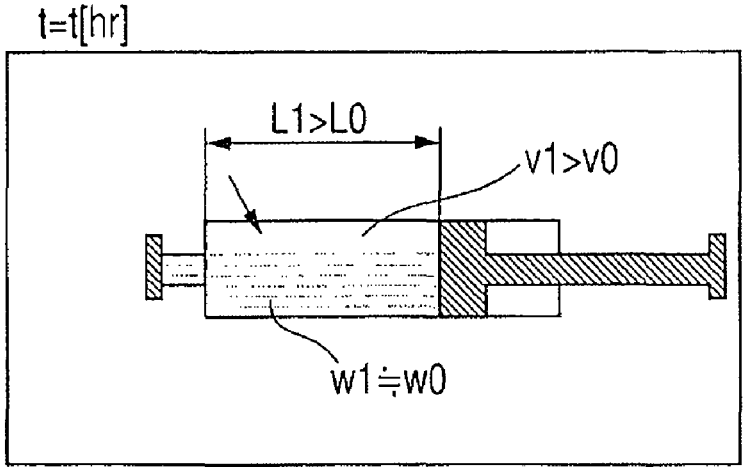

After elapse of time t (T=t [hr]), as shown in FIG. 3B, the piston 304 having the tip end thereof present at the position L0 at the time T=0 [hr] moves backwards, and an amount (volume v1) of the air in the syringe increases (v1>v0). On the other hand, an amount (w1) of the ink is substantially equal to w0. It is observed that there is hardly outflow to the outside air. This is considered as a result of invasion of the outside air into the air of the injector syringe due to a vapor pressure difference of the ink between the inside and the outside of the injector syringe.

Figure 4A:
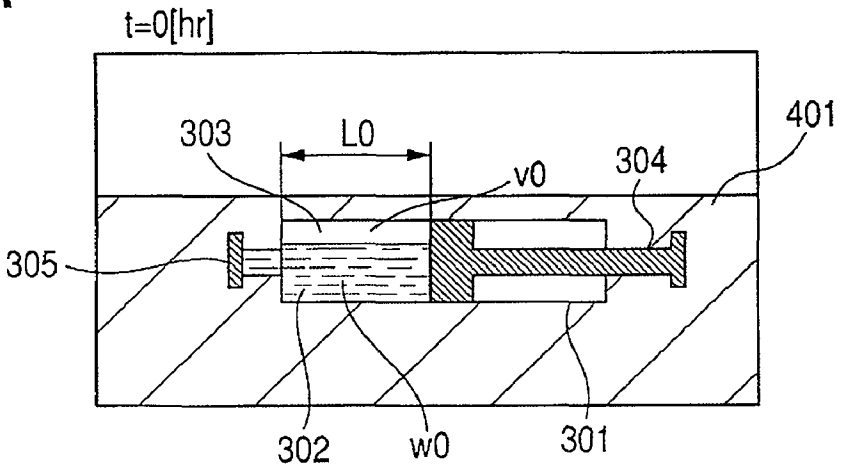
FIGS. 4A and 4B are explanatory views of a function of the ink tank for the ink jet recording device according to the present invention.
Figure 4B:
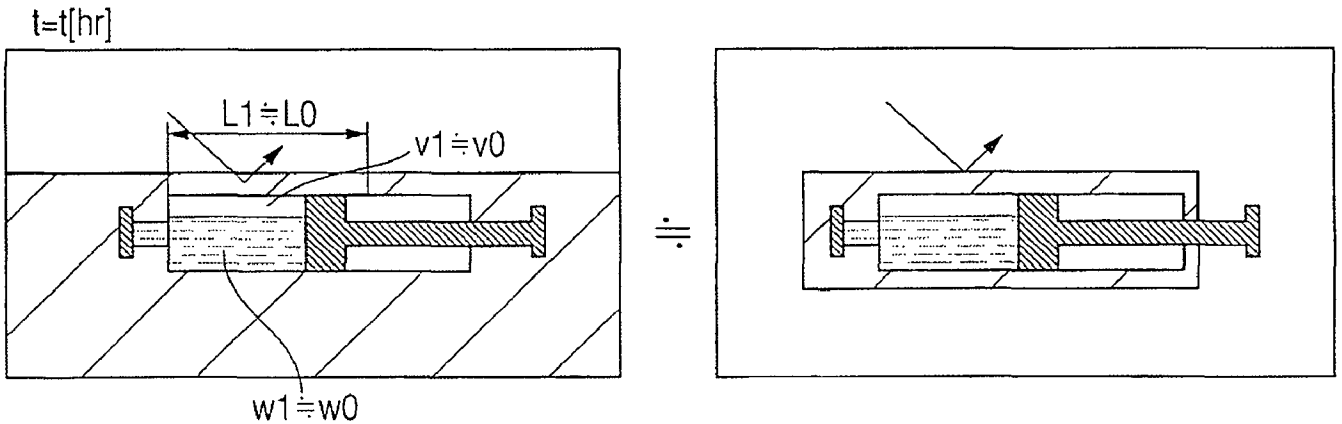

Next, the same injector syringe as described above is used. As shown in FIG. 4A, the whole injector syringe is immersed into ink 302, and observed in the same manner as described above. An injection syringe 301 sinks slightly under an interface 401 between the ink and air. After elapse of a time T=t, in the injector syringe, as shown in FIG. 4B, an amount v1 of air 303 is substantially equal to an amount v0 of the air at a time T=0. An amount w1 of the ink is also substantially equal to an amount w0 of the ink at the time T=0. In this manner, even after the elapse of the time t, a piston 304 hardly moves, and a tip end position L1 of the piston is substantially the same as the position L0. The invasion of the air into the syringe due to a gas osmic pressure difference is inhibited by a layer of the ink. A function similar to this function can inhibit the inflow and outflow of the gas between the inside and the outside of the ink bag.

As described above, a metal layer of aluminum heretofore disposed for a purpose of preventing the penetration of the gas is not required. A flexible plastic film can be used without using any evaporation film such as a metal. The flexible ink bag is deformed with consumption of the ink. Therefore, the negative pressure can easily and stably be applied to the ink stored in the bag, the ink is used up well, and a use efficiency of the ink in the ink tank improves. In general, the ink for the ink jet recording device is expensive. In consequence, a running cost can be reduced.

It has been described above that the coil spring is disposed, but in the ink tank for the ink jet recording device of the present invention, the coil spring may be replaced with a measure for appropriately applying the negative pressure if necessary. The measure may appropriately be selected. Alternatively, the measure for applying the negative pressure does not have to be disposed.

Embodiment 2

Figure 5A:
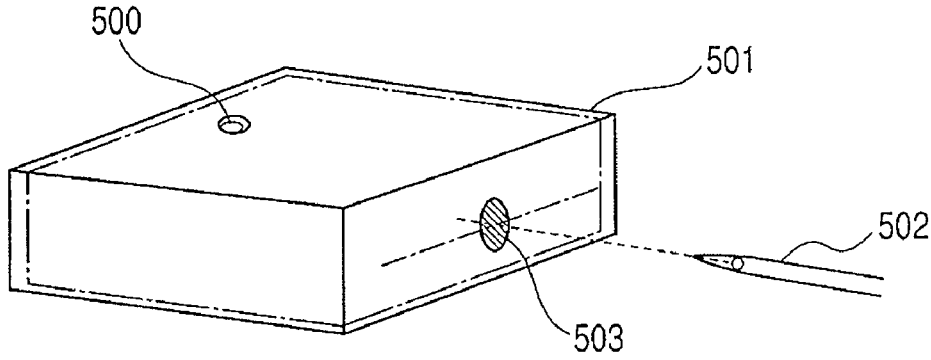
FIGS. 5A and 5B are schematic perspective views illustrating another example of the ink tank for the ink jet recording device according to the present invention.
Figure 5B:
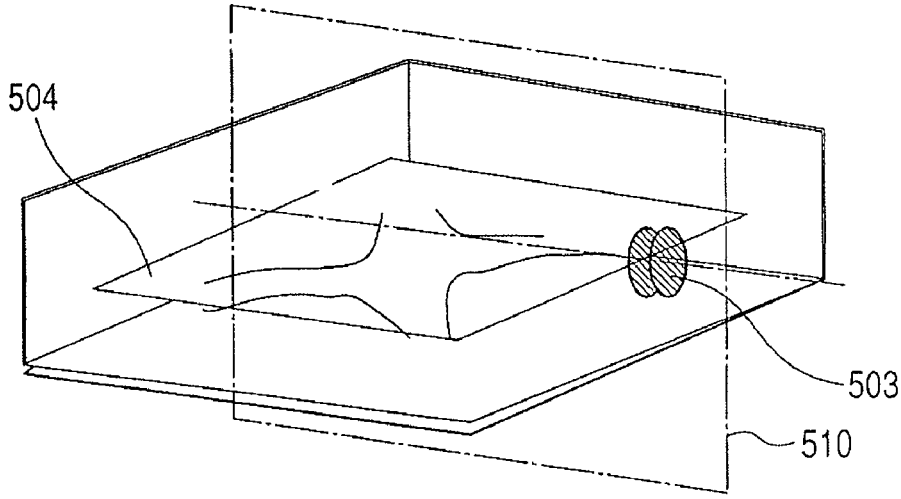
Figure 6:
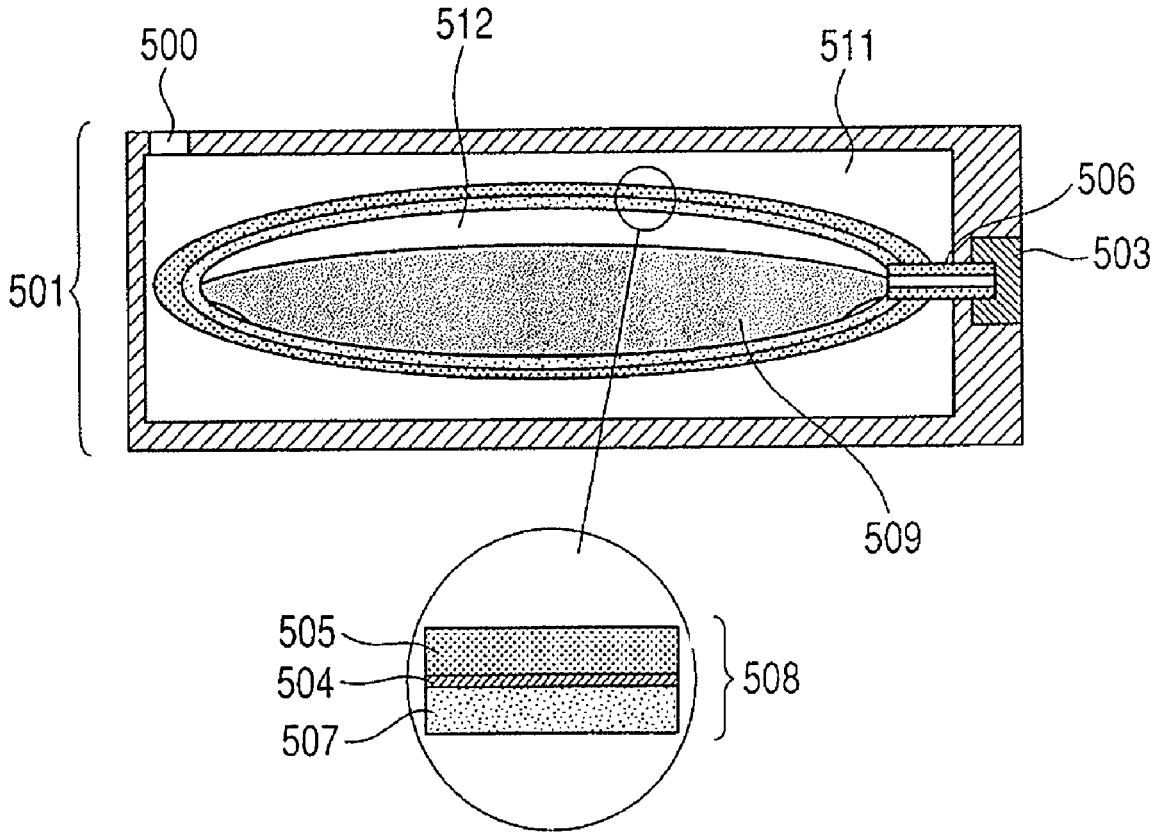
FIG. 6 is a schematic sectional view illustrating the example of the ink tank for the ink jet recording device according to the present invention.
Figure 7A:
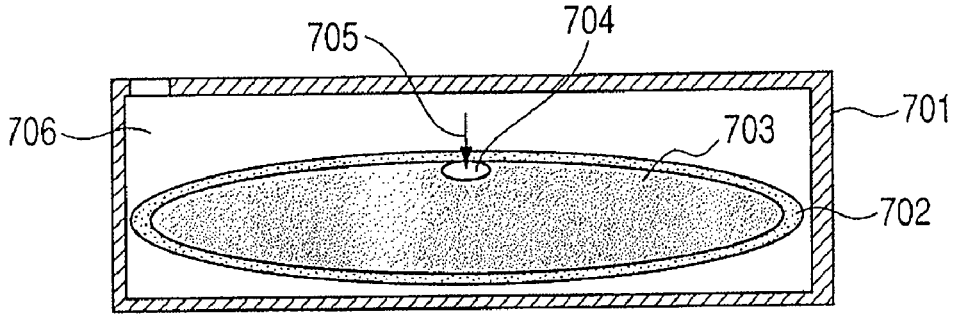
FIGS. 7A, 7B and 7C are sectional views showing a conventional example.
Figure 7B:
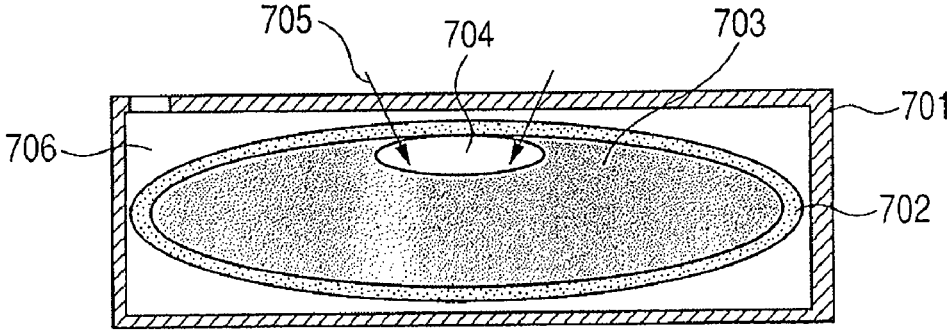
Figure 7C:
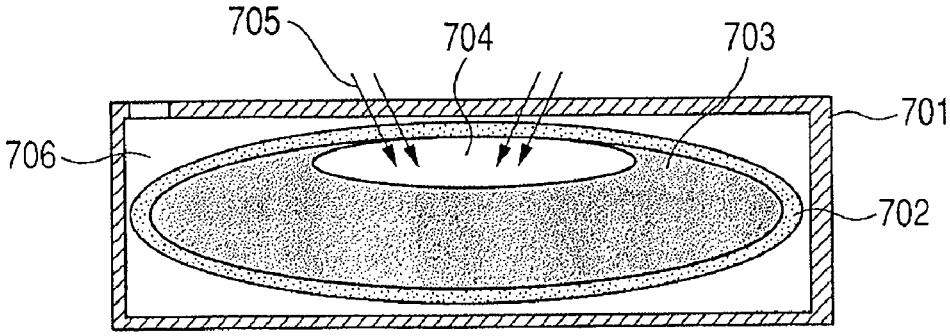

As another example of the ink tank for the ink jet recording device of the present invention, FIGS. 5A, 5B and 6 illustrate a replaceable ink cartridge. FIG. 5A is a schematic perspective view of the ink cartridge, FIG. 5B is a schematic perspective view cut along the broken line of FIG. 5A, and FIG. 6 is a schematic sectional view cut along a broken line 510 of FIG. 5B. The ink cartridge includes an ink bag 511 which is an ink storage section stored in the ink cartridge; an exterior material 501 in which the ink bag is stored; a rubber stopper 503 disposed at a side surface of the exterior material; and a guide tube 506 which connects the rubber stopper 503 to the ink bag 511. A hollow needle 502 is inserted into the rubber stopper 503 to form an ink channel between the ink bag and a discharge port of an ink jet recording head. Ink 509 can be derived from the ink bag to the channel, and discharged from the discharge port of the ink jet recording head.

The ink bag 511 of such an ink cartridge is formed of a composite material 508 having a coating layer 505 including a liquid retaining member capable of retaining the ink or an impregnated member which can be impregnated with a liquid. The coating layer is bonded to an outer side of a plastic film 507 through a bonding layer 504. In this case, the bonding layer can be omitted in a case where the coating layer can be fused to the plastic film 507. Specific examples of the plastic film 507 include a film formed of the same material as that described above in the plastic film 203 and having a thickness equal to that of the above plastic film.

The coating layer 505 includes the liquid retaining member capable of retaining a moisture or the impregnated member which can be impregnated with the liquid. Specific examples of the liquid retaining member and the impregnated member include members formed of the same material described above in the coating layer 205. As the moisture retained in the coating layer 505 including such a liquid retaining member or impregnated member, water can be used, but a part or all of waste ink generated at the start of the use of the ink jet recording device may be used. A measure for supplying the moisture and the waste ink to be retained in the coating layer 505 may be disposed. Moreover, a aperture diameter of an outside air communication port 500 and the number of the ports are adjusted, when the port is disposed at the exterior material 501. Furthermore, a volatilized amount of the moisture retained in the coating layer is adjusted, so that the coating layer 505 can constantly retain a wetted state.

Furthermore, as the liquid retaining member or the impregnated member included in the coating layer 505, a moisture adsorbent can be used. As the moisture adsorbent, the same adsorbent as described above may be used. Since the moisture adsorbent can adsorb the moisture from outside air, a measure for supplying the moisture does not have to be disposed in the coating layer in which this moisture adsorbent is used.

In such a coating layer, a layer of water or waste ink included in the liquid retaining member or the impregnated member is formed on an outer surface of the plastic film 507. Therefore, the plastic film 507 is separated through the layer of the water or the waste ink interposed between the film and the outside air, and does not come into direct contact. Therefore, even when a gas phase 512 is present in the ink bag 511, a gas can be inhibited from penetrating the plastic film. In the present embodiment, the water may be absorbed beforehand in the liquid retaining member, but the water or the waste ink may appropriately be introduced from the outside of the ink tank, and absorbed in the liquid retaining member. In consequence, the liquid retaining member constantly retains the water and the ink, and the penetration of the gas can securely be inhibited.

It has been described above that any negative pressure measure is not disposed in the ink bag, but a measure such as a coil spring for applying a negative pressure to the ink bag may be disposed if necessary.

Moreover, in the above embodiment, the ink bag is used as the ink storage section, but the present invention is not limited to this embodiment, and a vessel having a specific shape may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-144164, filed May 24, 2006, which is hereby incorporated by reference herein in its entirety.

What is claimed is:

1. An ink tank comprising:

an ink bag contained in the ink tank to define a space for containing ink;

wherein the ink bag is formed in a bladder shape with a multi-layered material having a plastic film layer, a bonding layer, and a coating layer comprising a liquid retaining member bonded to the plastic film layer through the bonding layer; and wherein the liquid retaining member retains ink in an interior of the liquid retaining member and is located at the innermost side of the ink bag.

2. The ink tank according to claim 1, wherein the liquid retaining member includes a foam material.

3. The ink tank according to claim 1, wherein the liquid retaining member includes a fiber material.

4. The ink tank according to claim 1, wherein the liquid retaining member includes a gel-like substance.

5. The ink tank according to claim 1, wherein the liquid retaining member includes a moisture adsorbent.

* * * * *